United States Patent [19]

Mitchell

[11] 3,974,960

[45] Aug. 17, 1976

[54] PLASTIC TRASH BAG TIE BANDS

[76] Inventor: John R. Mitchell, 44 Kearney Drive, Lowell, Mass. 01853

[22] Filed: June 23, 1975

[21] Appl. No.: 589,519

Related U.S. Application Data

[63] Continuation-in-part of Ser. No. 287,599, Sept. 11, 1972, abandoned.

[52] U.S. Cl. ..... 229/62; 24/30.5 P; 206/813

[51] Int. Cl.[2] ..... B65D 33/30

[58] Field of Search ..... 229/62, 65; 150/3; 206/813; 24/30.5 P

[56] References Cited

UNITED STATES PATENTS

| | | | |
|---|---|---|---|
| 3,285,499 | 11/1966 | Repko | 229/62 |
| 3,311,288 | 3/1967 | Lemelson | 229/65 |
| 3,565,738 | 2/1971 | Kirkpatrick | 229/62 X |
| 3,587,845 | 6/1971 | Wing | 206/813 |
| 3,806,024 | 4/1974 | Marchesani | 229/62 |

*Primary Examiner*—Stephen P. Garbe
*Attorney, Agent, or Firm*—Pearson & Pearson

[57] ABSTRACT

A plastic trash bag having peelably attached thereto a full length tie strip formed of another plastic material. The strip extends along an entire face of the bag in parallelism with the machine direction and is peelable from the bag as a substantially non-adhesive bearing tie strip. The plastic tie strip is "string-like" in configuration, with a length to width ratio ranging between a minimum of 50 to 1 and a maximum of 1000 to 1 but preferably about 250 to 1 so that it can be easily tied despite its length. A layer of low tack, spot patterned adhesive adheres the strip to the bag. Width to thickness is advantageously about 50 to 1. The tie strip is not heat sealed or bonded to the trash bag.

4 Claims, 7 Drawing Figures

PLASTIC TRASH BAG TIE BANDS

RELATED APPLICATIONS

This application is a continuation-in-part of my application Ser. No. 287,599 filed Sept. 11, 1972, now abandoned.

BACKGROUND OF THE INVENTION

With the advent of large scale use of plastic bags for trash disposal, it has become an increasing problem to assure that means are provided for closing the bags in such a way that their contents are not prematurely spilled.

Considerable inventive effort has been spent on this or analogous closure problems. For example, O'Brien, in U.S. Pat. No. 2,849,171, discloses an adhesive strip spot-welded to a plastic bag and partly peelable therefrom to form an attached adhesive-tape closure. Bostweck, in U.S. Pat. No. 3,412,926, provides a similar adhesive-tape closure, except that it may be peeled in its entirety and used as an adhesive closure. Other inventors, such as Shvetz, in U.S. Pat. No. 3,217,971, have formed fixed-position closures from the same sheet of which the bag itself is formed. Also, some closures require a locking means, such as the clip disclosed in U.S. Pat. No. 3,334,805 to Halback and closures described in U.S. Pat. Nos. 3,417,864 and 3,417,912 to Paxton.

Kirkpatrick, in U.S. Pat. No. 3,565,738, describes a dead-fold type of plastic tie which is adhesively attached to the trash bag with which it is to be used.

The present inventor has perceived a number of problems exist with these prior art products or methods by which they are produced. These include excessive expense of material or forming steps and too little flexibility in the position or size of the tie means.

Marchesani, in U.S. Pat. No. 3,806,024 discloses a small sandwich bag having a wide tape heat sealed and bonded to the bottom and adhered with pressure sensitive adhesive to close the bag.

SUMMARY OF THE INVENTION

It is an object of the present invention to produce an improved disposable plastic film bag with a readily peelable, tack-free tie strip mounted thereon, the tie strip being completely removable without tearing the bag.

A further object of the invention is to provide a bag comprising a tie strip of sufficient length to provide a versatile bag closing means, by tying around the neck of the bag.

Another object of the invention is to provide a tack free tie strip which does not require a weld, or fusion, seal to the bag to which it is attached and is held in place only by spots of low tack adhesive to create finger openings.

Other objects of the invention will be obvious to those skilled in the art on reading the instant application.

The above objects have been largely achieved by construction of a plastic bag wherein the tie strip is fastened to the bag only by means of a hot melt adhesive which has relatively little adhesive character at normal temperatures, say those from 0° to 100°F., but which provides a sufficient residual bond to hold the strip to the bag material. When easily and peelably removed from the bag, this strip will not exhibit any substantial residual adhesive character; consequently, it can be tied into a knot around the neck of the bag without interference from such an adhesive.

The tie strip of the invention is relatively long and stringlike and it extends along substantially the entire length or width of the bag. This length aspect of the invention is made desirable by several considerations. A relatively low-strength adhesive is more effective as its effective area is increased by the length of the strip. It is undesirable to achieve this area by increasing the width of the strip unduly because a narrow strip facilitates easier tying when using the plastic strip materials of choice. Finally, it has been found that a relatively long strip provides a desirable versatility in the diameter of the closure of the bag, thereby dispensing with the necessity of a narrow neck closure where the contents of the bag do not require such a closure.

The bag component of the invention is manufactured from such organic thermoplastic materials as polyethylene, polypropylene, or the like. Polyester, such as that sold under the trade designation Mylar by duPont or Celanar by Celanese Corp., nylon, polyvinylchloride and other such known materials may also be used. As a general rule, the polymer is selected on a cost/performance basis, with attention to its tear resistance (i.e., its toughness), or, in the case of an oven bag, its heat resistance, etc. Depending upon the use intended for the bag, the wall thickness of the plastic film of the conventional trash bag is from about 0.0005 to about 0.003 inches.

The tie strip or "tape" can be made from any of the above mentioned materials, nylon, styrene-butadiene-rubber polymers, thermoplastic polyurethane type materials, and like thermoplastics. Polypropylene is advantageous for use, not only because of its strength, but also because of its elongation and elasticity properties which contribute to a self-tensioning of a knot formed therewith. However, it should also be noted that dead-fold materials, such as described by Kirkpatrick in U.S. Pat. No. 3,565,738, may also be used as the tape material.

The tape material is string-like in shape, i.e. about 0.025 to 0.200 inches in width and 0.0005 to 0.005 inches in thickness. The width-to-thickness ratio is thus about 50 to 1. The length-to-width ratio is advantageously at least 50 to 1, to about 1000 to 1 but preferably 250 to 1. The tape should have a tensile strength of at least about five pounds when tested according to any well known method by means of well known equipment, such as a Scott or Instron tester.

The hot-melt adhesive is conveniently based on a microcrystalline wax having a melting point in the range of 155°–185°F, and preferably of about 170°F, together with tackifying agents, such as rosin esters or the like. The important characteristic of these materials is that they adhesively bond to both tape and bag at the application temperature and are relatively tack-free below 100°F or so.

The hot-melt adhesive is typically applied to a tie strip as a strip 0.002 inches thick and about 0.010 to 0.100 inches wide, in sufficient volume to make an adequate bond to the bag material. A typical adhesive is that obtainable as Wex 5825 of Sun Oil Company of Philadelphia, Pa. Another suitable adhesive is commercially available from Bareco Division of Petrolite Corporation of Ardmore, Pa.

The process by which the above described bags are formed comprises the steps of extruding a plastic sheet, balloon, or tube, forming it into flattened tubular configuration and contacting the resultant flattened tubular sheet with an adhesive coated tie strip. Heat sealing and cutting means are used to complete the formation of the bags themselves.

ILLUSTRATIVE EXAMPLE OF THE INVENTION

In this application and accompanying drawings, there is shown and described a preferred embodiment of the invention and various alternatives and modifications thereof are suggested, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it and embody it in a variety of forms, each as may be best suited in the condition of a particular case.

BRIEF DESCRIPTION OF THE DRAWINGS

FIG. 1 illustrates a process whereby a plastic film 10 is extruded from a tubular die 12 and air-cooled before being flattened between rollers 14 and carried in the flattened condition onto an endless belt 16. Above table 16 is suspended roll 18 of polypropylene tape 20. One side 21 of tape 20 is coated with a hot-melt adhesive 22 at coating station 24 and then, depending on the speed of process, brought into bonding contact with film 10 between roller, or shoe, 26 and table 16. A heat sealing apparatus 28 forms means to seal the double thickness of film at intervals, which are generally equivalent to the desired length of the plastic bags being formed. The bags can be melt cut with a heated knife at this station 28, or only heat sealed and cut at a subsequent station not shown.

FIG. 2 shows a finished bag 30 of the type formed by the process illustrated in FIG. 1. Tape 20 is affixed along the length of the bag extending over a portion of the heat seal 32 at 34.

FIG. 3 shows another bag 35, one which is formed of a flat sheet folded at 36, and heat sealed along each of margins 38. A polypropylene tie tape 40 is affixed with a hot-melt adhesive parallel to the fold across the width of the bag.

Figure 1:
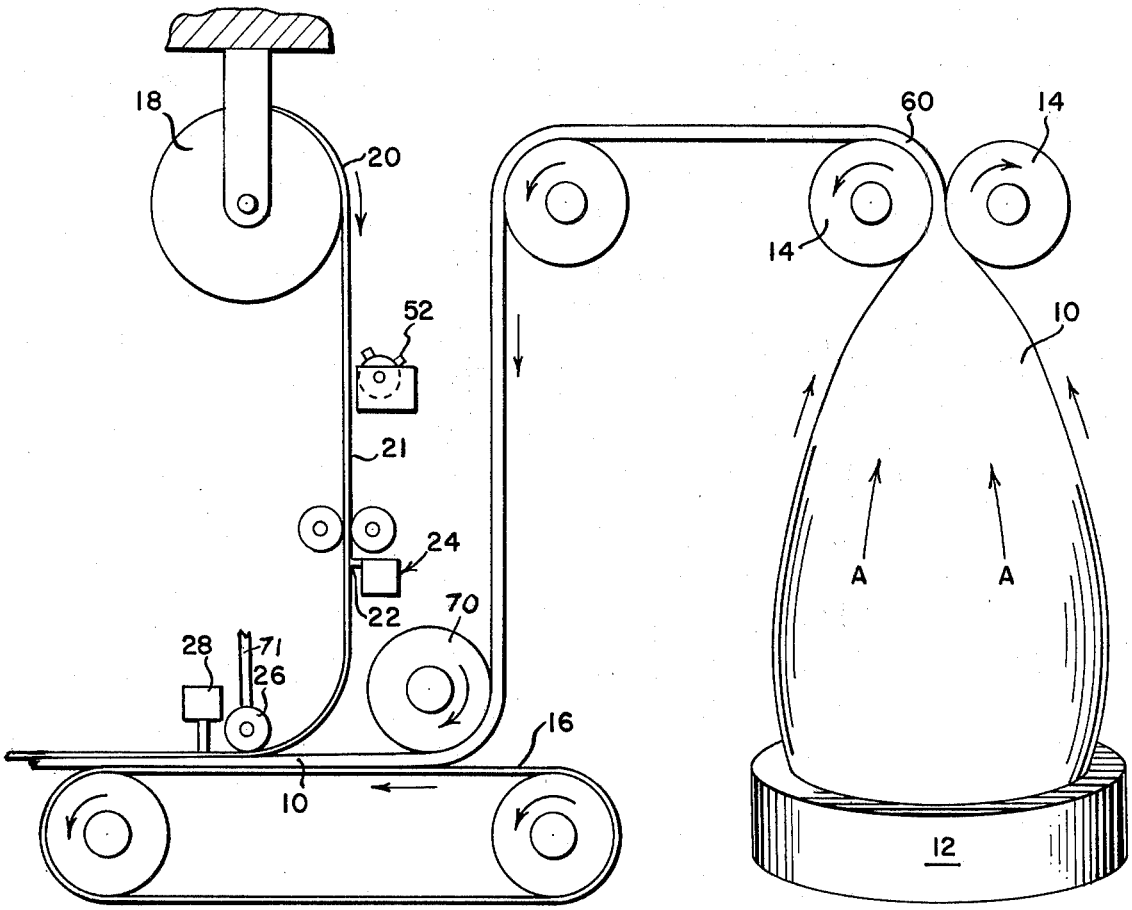
FIG. 1 is a schematic representation of a process for making a tie-strip-bearing plastic trash bag according to the invention.
Figure 2:
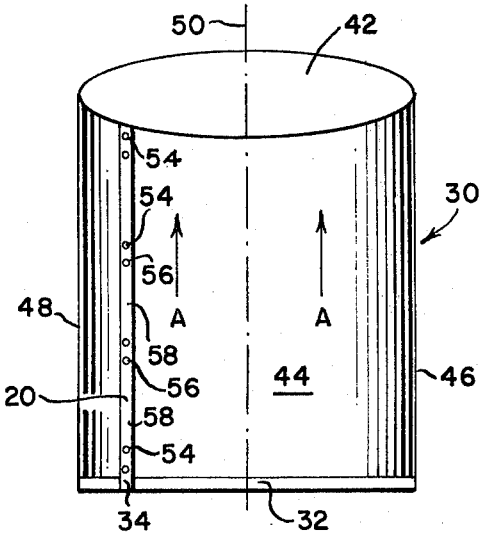
FIGS. 2 and 3 are trash bags prepared according to the invention, but schematic with respect to dimension thereof.
Figure 3:
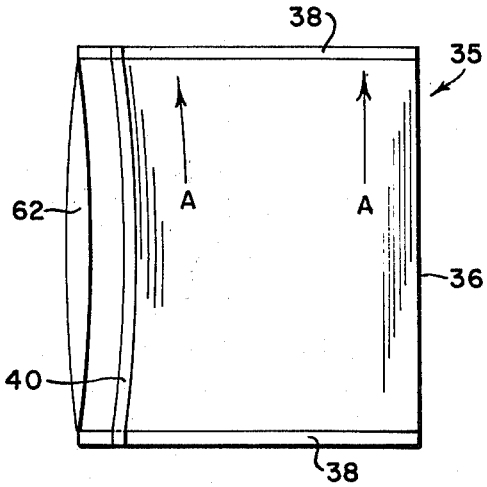
Figure 4:
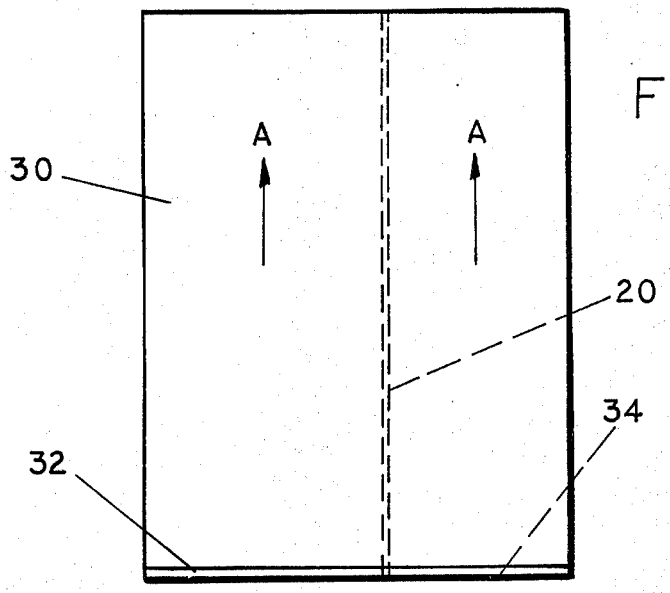
FIG. 4 is a side elevation of a plastic trash bag of conventional size showing in dotted lines the area occupied by a peelably removed tie strip.
Figure 5:
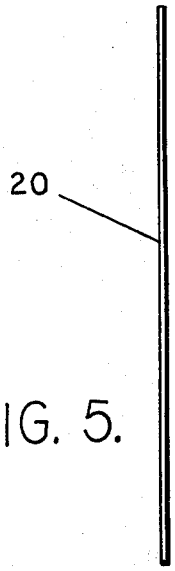
FIG. 5 is a side elevation of the string-like plastic tie strip of the invention removed from the bag.
Figure 6:
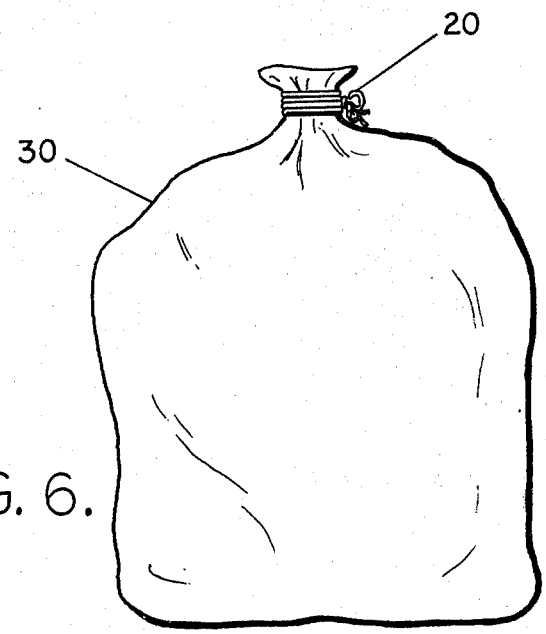
FIG. 6 is a side elevation of a filled trash bag showing the string-like plastic tie strip, wrapped around the bag neck in several convolutions and tied in a knot.
Figure 7:
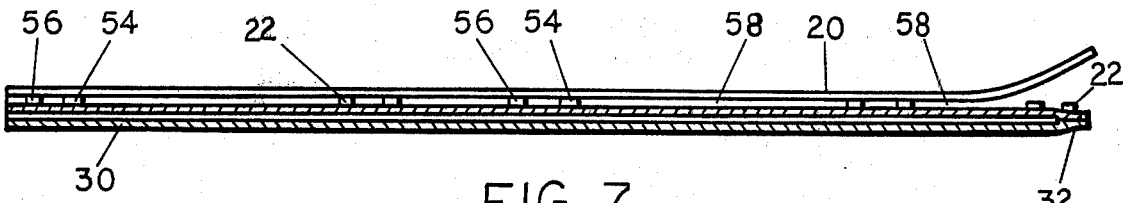
FIG. 7 is a side elevation in section showing the tie strip being peelably removed from the spot pattern of low tack adhesive.

In such bags as shown in FIGS. 2 and 3, wherein the strip overlaps the heat seal, the wax adhesive is further spread during heat sealing and the relative strength of the adhesive and its substrate, a double thickness of plastic film, becomes exceptionally low, thereby providing a particularly advantageous place to initiate removal of the tie strip.

In the bag of FIG. 2, the tubular web, or balloon, 10 has a machine direction indicated by the arrows A with the narrow flexible tie tape 20 extending in parallelism therewith normal to the bag opening 42, for substantially the full distance across face 44 from side edge 46 to side edge 48. The layer of adhesive 22 detachably bonding tape 20 at a spaced distance from the longitudinal center line 50, proximate the side edge 48, may be continuous, but may also be applied by a suitable pattern, or spot, applicator roll 52 to form interrupted areas 54 and 56, thereby creating spaced finger holes such as 58. The heat seal 32 constitutes the bag bottom in FIG. 2.

In the bag of FIG. 3, the continuously advancing tubular balloon or web 10 has been slit, as at 60, so that one side edge is fold 36. The opening 62 is at the other side edge and the tape 40 has been applied in parallelism with the machine direction A, preferably near the opening 62 for convenience.

Heat sealing apparatus 28 may include a hot wire for sealing, and also severing, the bags or may create a perforated line of severance dividing the web into individual bags, all in a known manner.

While the tie tape 20 is preferably affixed in parallelism with the machine direction A, or grain, of the plastic, the term generally in parallelism is used because the guide roll 70 or the nip roll 26 may be arranged to reciprocate or oscillate laterally to apply the tape in a slightly oblique fashion, still generally aligned with the machine direction, but slightly out of parallelism therewith. A swing arm support 71 for roll 26 diagrammatically illustrates such a mechanism, powered by suitable linkage not shown.

It should be noted that it would defeat the purpose of the string like tie tapes 20 or 40 if they were relatively short and wide and if they were heat bonded to the face of the bag because removal would not be easy, it would be difficult to lift an edge, removal would tear the bag and tying a wide tape into a tight knot is difficult.

Thus the "string-like" tape, "low tack" adherence and spot pattern of adhesive of this invention permits the tie tape to be lifted in the finger spaces between adhesive spots, then easily peeled off without damaging the trash bag and then tied around the neck of a full bag into a tight knot.

For the conventional plastic trash bag of about 30 inches in width, about 37 inches in length and wall thickness of 0.0015 inches, a plastic tie tape is recommended of about 0.002 inches in thickness, about 0.100 inches in width and 30 to 37 inches in length depending on machine direction of the plastic in the bag.

It is to be understood that the following claims are intended to cover all of the generic and specific features of the invention herein described.

I claim:

1. A container comprising:

a large size bag of the type for containing trash, leaves and the like and to be tied around the neck rather than adhesively closed;

said bag being formed of plastic material having a machine direction and having side walls of predetermined length and width terminating in a heat sealed closed end and an opposite open end;

an elongated, polymeric, tie tape of predetermined length and width, formed of material separate from the plastic material of said bag and impermanently attached thereto, said tie tape being string-like in configuration with a length to width ratio of at least 50 to 1 and a width of about 0.025 to 0.200 inches;

a layer of hot melt, low tack, wax based adhesive, which is substantially tack free below 100°F, and which is not a part of said plastic bag or of said polymeric tie tape, said layer being interrupted in a predetermined pattern of longitudinally spaced spots to form finger holes and peelably affixing said elongated tie tape in an impermanent, readily removable manner along the full length of one said wall of said bag, in parallelism with said machine direction;

said tie tape extending from the open end of said bag, to the closed end of said bag and extending over the heat sealed closed end thereof, the portion thereof overlapping said heat sealed end being exceptionally low in adhesive strength;

said tape at said heat sealed closed end providing a place to initiate the peelable removal of said tape in addition to the finger receiving spaces under the portions of said tape between said spots of adhesive, and said tape forming a substantially non-adhesive tie strip when peeled off said trash bag which can be tied in a knot without interference from said adhesive.

2. A container as specified in claim 1 wherein:

said polymeric tie tape and said layer of spot patterned, low-tack, adhesive extend along said one wall of said bag from one end to the other proximate one longitudinal edge of said bag, whereby said tape is offset from the longitudinal center line of said wall and does not create undue thickness when said containers are folded and superposed.

3. A container comprising:

a large size bag of the type for containing trash, leaves and the like and to be tied around the neck rather than to be adhesively closed;

said bag being formed of plastic material having a machine direction, or grain, and having at least one heat sealed edge portion;

said bag having a pair of opposite, rectangular side walls, a closed end and an opposite open end, an elongated plastic tie tape, impermanently attached to said bag, said tape being formed of plastic material independent of the plastic in said bag, said tape being string-like in configuration and extending entirely across one said wall of said bag from one edge to the other, said tape having a length to width ratio of at least 250 to 1 and a width of about 0.025 to 0.200 inches;

an elongated layer of low tack adhesive, coextensive in length with said tie tape and peelably affixing said tape to said one side wall of said bag in an impermanent, readily removable manner, said tape extending acorss said side wall of said bag in parallelism with the said machine direction of the plastic thereof and extending over said heat sealed edge portion but being exceptionally low in adhesive strength over said edge portion to provide a place at said edge portion to initiate peelable removal of said tape, said tape forming a substantially non-adhesive tie strip, when peeled from said bag to be tied into a knot without interference from said adhesive.

4. A container for refuse, trash, leaves, and the like, said container comprising:

a trash bag of plastic material having a machine direction, said trash bag having a closed bottom, an open mouth, a front wall, a back wall, a heat sealed edge and three other edges;

a separate, deformable tie tape of string-like configuration impermanently attached to said bags, said tape having opposite ends and a length-to-width ratio of one thousand to one, said tape extending entirely across one of said walls, in parallelism with said machine direction, with one end overlying said heat sealed edge and the other end reaching to an opposite edge; and a layer of hot melt, low tack, wax-based, adhesive which is substantially tack free below 100°F, peelably affixing said tie tape along the full length of said tape and of said wall, the said portion thereof overlying said heat sealed edge being exceptionally low tack;

said overlying portion of said tape providing means to initiate the peelable removal of said tape for forming a substantially adhesive free tie tape to be tied into a knot around the neck of the bag without interference by said adhesive.

* * * * *